United States Patent [19]

Down

[11] Patent Number: 4,923,111

[45] Date of Patent: May 8, 1990

[54] COMBINATION MAILING ENVELOPE AND FILE FOLDER

[75] Inventor: Douglas G. Down, Omaha, Nebr.

[73] Assignee: Omaha Printing Company, Omaha, Nebr.

[21] Appl. No.: 357,086

[22] Filed: May 25, 1989

[51] Int. Cl.[5] ..... B65D 27/34

[52] U.S. Cl. ..... 229/68 R; 229/1.5 R; 206/610

[58] Field of Search ..... 229/68 R, 74, 72, 1.5 R, 229/82, 92.7; 206/610

[56] References Cited

U.S. PATENT DOCUMENTS

| | | | |
|---|---|---|---|
| 1,755,814 | 4/1930 | Cox | 229/74 |
| 1,922,213 | 8/1933 | Middleton | 206/610 X |
| 2,345,793 | 4/1944 | Chapel | 206/610 X |
| 3,756,468 | 9/1973 | Holmes | 229/72 X |
| 4,765,485 | 8/1988 | Perkins | 229/74 X |

*Primary Examiner*—Stephen Marcus
*Assistant Examiner*—Jes F. Pascua
*Attorney, Agent, or Firm*—Zarley, McKee, Thomte, Voorhees & Sease

[57] ABSTRACT

A combination mailing envelope and file folder is provided wherein the envelope, when opened and torn along tearable score lines, will result in the creation of a file folder.

3 Claims, 3 Drawing Sheets

COMBINATION MAILING ENVELOPE AND FILE FOLDER

BACKGROUND OF THE INVENTION

This invention relates to a mailing envelope and more particularly to a mailing envelope which, when opened, may be used as a file folder.

In many businesses such as in the insurance business, an envelope containing documents relating to a new customer are forwarded to the home office. When the envelope of material is received in the home office, the material is removed from the envelope and is normally placed in a file folder. The envelope is then discarded.

It is therefore a principal object of the invention to provide a mailing envelope which may be converted into a file folder after the envelope has been opened.

A further object of the invention is to provide a combination mailing envelope and file folder.

Yet another object of the invention is to provide a mailing envelope which is easily opened and which forms a file folder.

Yet another object of the invention is to provide a mailing envelope which may have client information imprinted thereon which will be displayed on the file folder which is formed after the envelope has been opened.

Still another object of the invention is to provide a combination mailing envelope which is economically manufactured, durable in use and refined in appearance.

These and other objects of the present invention will be apparent to those skilled in the art.

SUMMARY OF THE INVENTION

Figure 1:
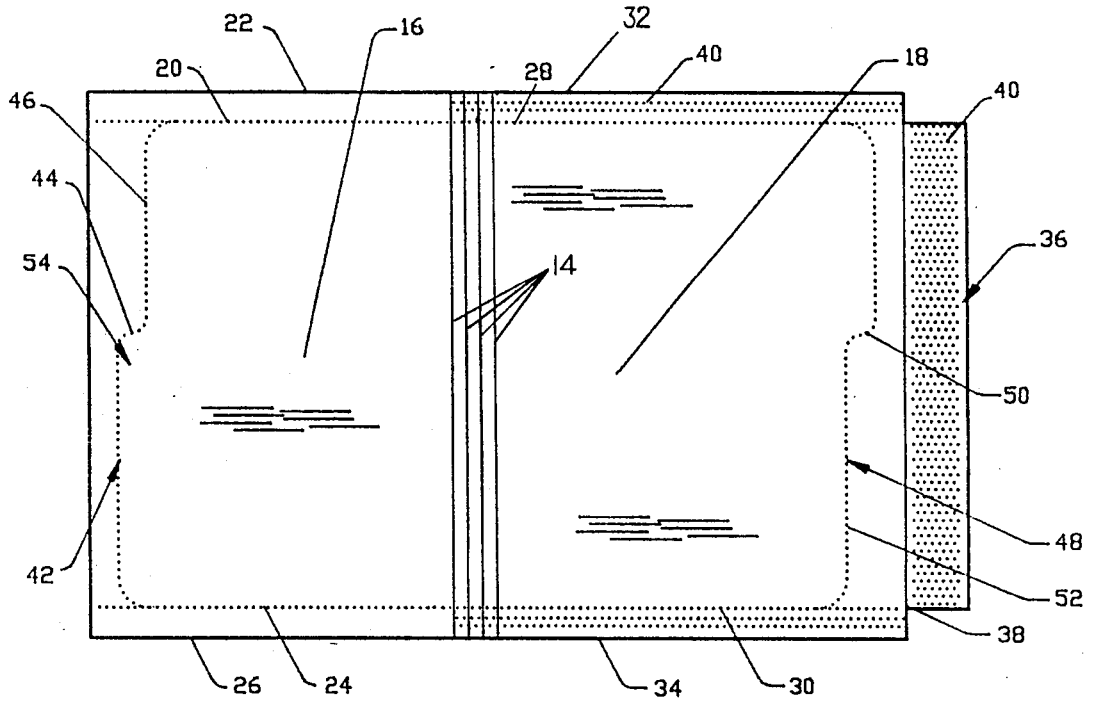
FIG. 1 is a front elevational view of the combination mailing envelope and file folder of the present invention.
Figure 2:
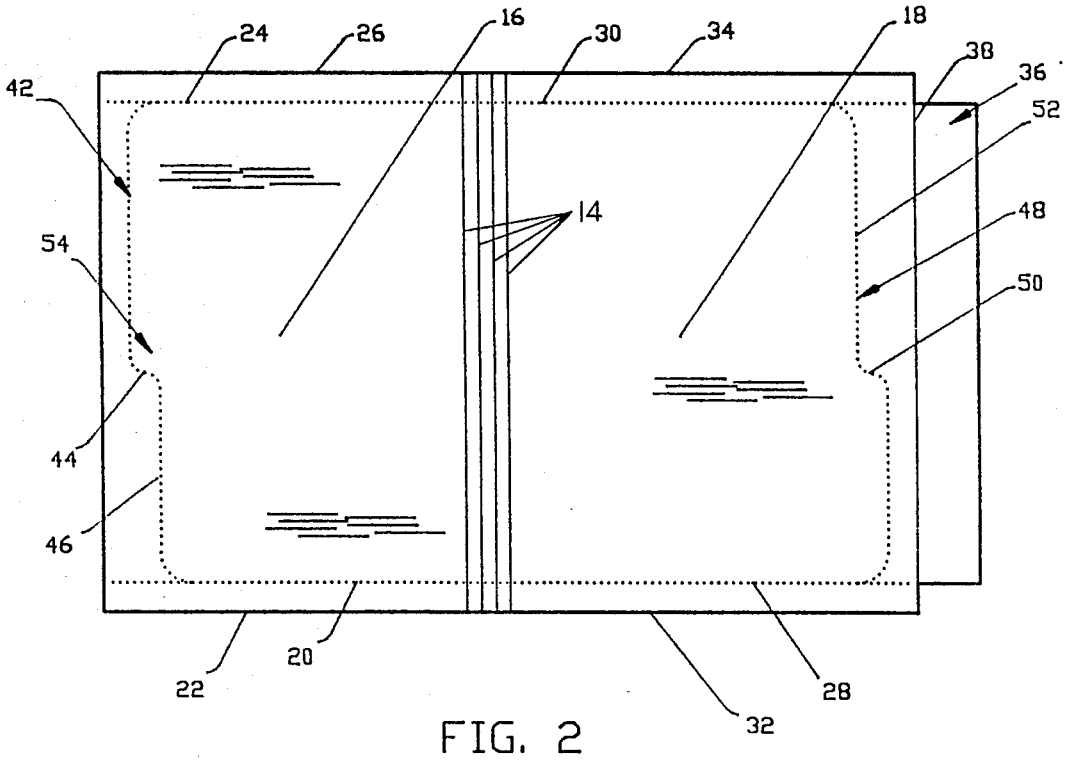
FIG. 2 is a rear elevational view of the invention.
Figure 3:
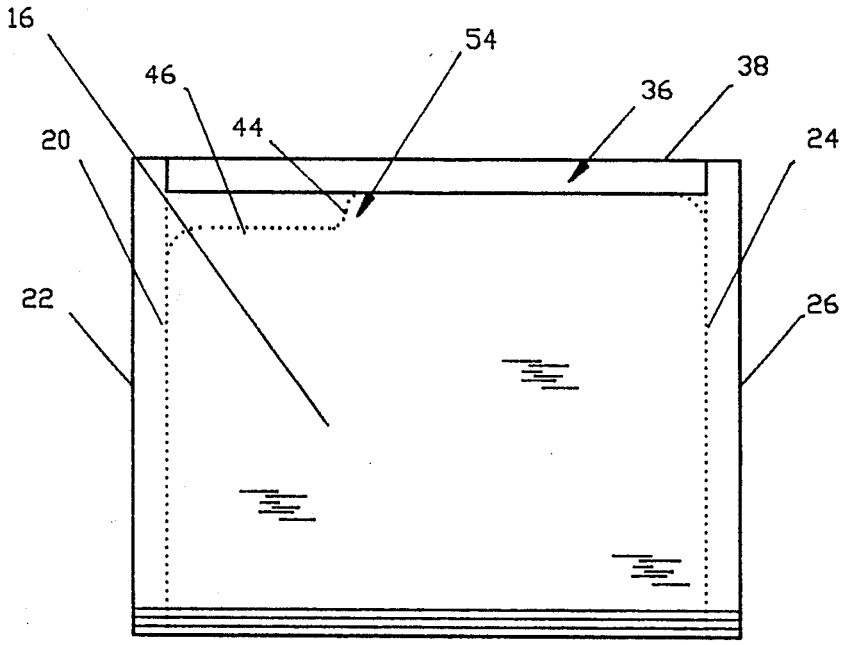
FIG. 3 is a rear elevational view of the invention after one fold has been made.
Figure 4:
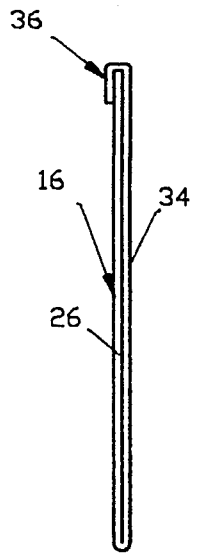
FIG. 4 is a front elevational view of the invention after a second fold has been made.
Figure 5:
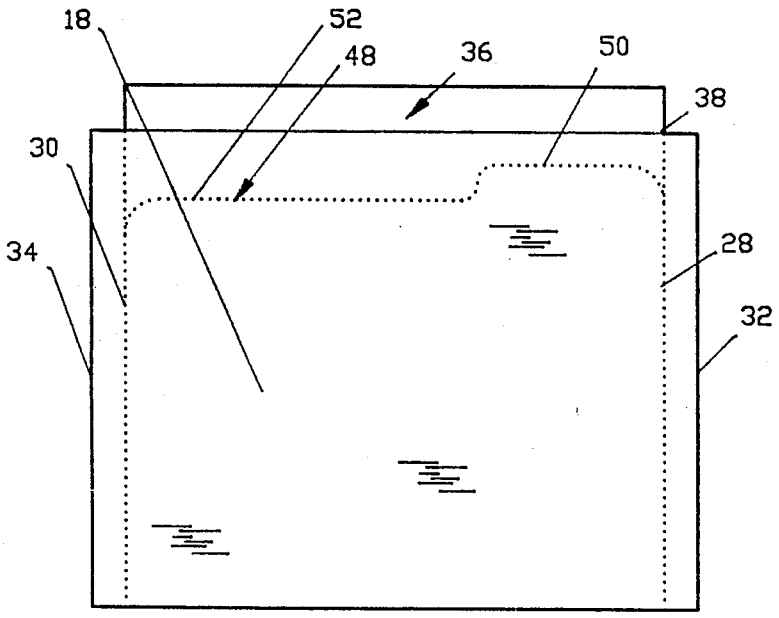
FIG. 5 is a side view of FIG. 4.
Figure 6:
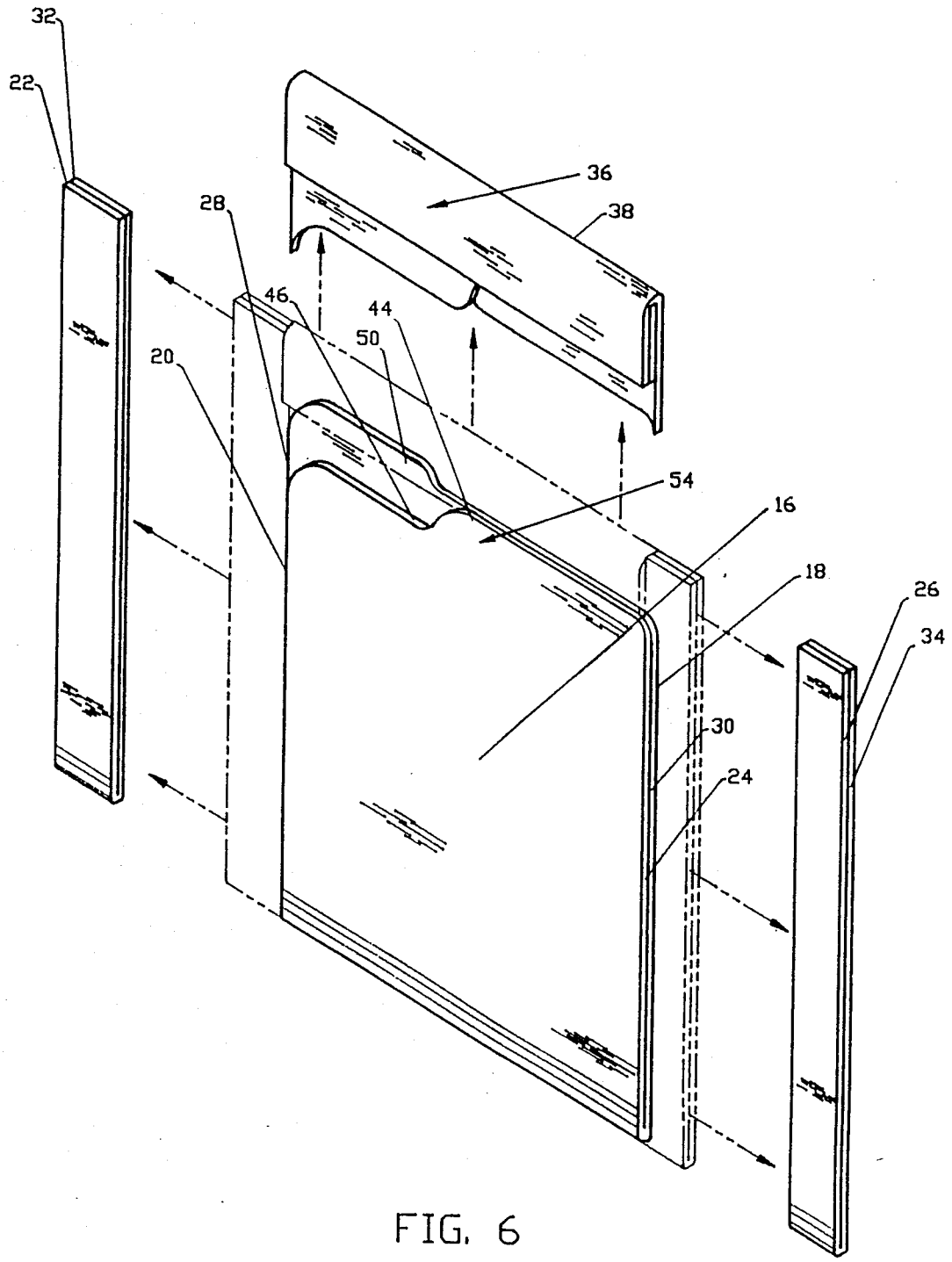
FIG. 6 is an exploded perspective view of the invention with the separable elements removed from the folder.

A mailing envelope comprising a sheet which is folded upon itself to form front and back sheet members foldably joined at their lower edges. The side edges of the superimposed sheet members are secured together with suitable adhesive so as to define an envelope pocket therebetween. The rear sheet member is provided with a flap portion at the upper edge thereof which may be folded over the upper edge of the front sheet member and secured thereto by some form of adhesive. The front and rear sheet members are provided with registering, tearable score lines faced inwardly from the side edges thereof and spaced inwardly from the adhesive securing the side edges together. The front and rear sheet members are also provided with tearable score lines formed therein above the lower ends thereof so that the upper end of the envelope may be opened to gain access to the interior of the envelope. When the envelope has been so opened at the upper portion thereof and the side portions of the sheet members removed, a file folder is provided.

DESCRIPTION OF THE PREFERRED EMBODIMENTS

The combination mailing envelope and file folder of this invention is referred to generally by the reference numeral 10. Envelope 10 is formed from a single sheet 12 which is folded upon itself along one of a plurality of parallel spaced-apart fold lines 14 to form a front sheet member 16 and a back sheet member 18 which are positioned in a superimposed relationship.

Front sheet member 16 is provided with a tearable score line or tear line 20 which extends from the lower end of the sheet member to the upper end of the sheet member as seen in the drawings and which is spaced inwardly from side edge 22. Sheet member 16 is also provided with a tearable score line 24 faced inwardly from side edge 26 which extends from the upper end to the lower end thereof as seen in the drawings. Similarly, back sheet member 18 is provided with tearable score lines 28 and 30 which register with score lines 20 and 24, respectively, and which are spaced inwardly of side edges 32 and 34 respectively.

Sheet members 16 and 18 are secured together at their side edges by suitable adhesive between the score lines and the respective side edges to form an envelope having an open upper end. Back sheet member 18 is provided with a flap portion 36.Which may be folded along fold line 38 so as to be positioned over the upper end of sheet member 16. Flap portion 36 is provided with some form of suitable adhesive generally referred to by the reference numeral 40 so that the flap portion 36 may be utilized to seal the upper portion of the envelope.

Sheet member 16 is provided with a tearable score line 42 which extends across the portion thereof below the lower end of flap portion 36 in the manner illustrated in the drawing so as to define a tab portion 44 and recessed portion 46. Sheet member 18 is also provided with a tearable score line 48 which extends across the upper end thereof below fold line 38 so as to define a tab portion 50 and a recessed portion 52. As seen in the drawings, tab portion 50 is spaced behind the recessed portion 46 or to the left of tab portion 44 to facilitate opening the file folder. Preferably, the tearable score lines 42 and 48 are designed so that file folders having the tabs in various customary positions will be provided. In other words, some of the file folders will have the tab portions positioned at the upper left portion of the file folder while others will have the tabs formed in the center or at the right portion of the file folders.

In use, the envelopes 10 may be pre-printed with certain customer information thereon. The user will insert the material to be forwarded to the addressee and the flap portion 36 will be sealed to the upper portion of sheet member 16. When the envelope is received by the addressee, the side portions of the sheet member 16 and 18 will be removed therefrom along the score lines 20–28 and 24–30. The upper portion of the envelope will then be removed by tearing the same along the score lines 42 and 48. When the envelope has been so torn, the result is the creation of a file folder referred to generally by the reference numeral 54. Thus, the addressee need not place the material in the envelope in a separate file folder since the material is already in a file folder provided to the addressee by the addressor.

Thus, it can be seen that a novel combination mailing envelope and file folder has been provided which accomplishes at least all of the stated objectives.

I claim:

1. A combination mailing envelope and file folder comprising: a front sheet member having an upper end, opposite side edges, and a lower end, a back sheet member of substantially the same dimensions as said front sheet member and having an upper edge, opposite side edges, and a lower end, said back sheet member being superimposed with respect to said front sheet member, the lower ends of said sheet members being joined, adhesive means securing the side edges of said sheet members together, said back sheet member having a flap portion foldably connected to the upper end of said back sheet which is adapted to be folded over the upper end of said front sheet member and secured thereto to form a mailing envelope, said front and back sheet members having registering tearable score lines formed therein inwardly of the adhesive means securing the side edges thereof together, said front and back sheet members having tearable score lines formed therein below the upper ends thereon and below the foldable connection of said folded flap portion to said back sheet, and said tearable score lines providing a means for opening the envelope and for providing a file folder with the remaining portions of said sheet members after the sheet members have been torn along the tearable score lines.

2. The combination of claim 1 wherein the tearable score lines formed in the sheet members below the upper ends thereof define upstanding tab portions.

3. A combination mailing envelope and file folder comprising:

a front sheet member having an upper end, opposite side edges, and a lower end, a back sheet member of substantially the same dimensions as said front sheet member and having an upper edge, opposite side edges, and a lower end, said back sheet member being superimposed with respect to said front sheet member, the lower ends of said sheet members being joined, adhesive means securing the side edges of said sheet members together, said back sheet member having a flap portion foldably connected to the upper end of said back sheet which is adapted to be folded over the upper end of said front sheet member and secured thereto to form a mailing envelope, said front and back sheet members having registering tearable score lines formed therein inwardly of the adhesive means securing the side edges thereof together, said front and back sheet members having tearable score lines formed therein below the upper ends thereon and below the foldable connection of said folded flap portion to said back sheet, said tearable score lines providing a means for opening the envelope and for providing a file folder with the remaining portions of said sheet members after the sheet members have been torn along the tearable score lines, and said front sheet member having a plurality of spaced-apart foldable score lines formed therein above the lower end thereof.

* * * * *